US010045606B2

(12) United States Patent
Cirincione, II et al.

(10) Patent No.: US 10,045,606 B2
(45) Date of Patent: Aug. 14, 2018

(54) IMPACT-ABSORBING TETHERING ATTACHMENT

(71) Applicant: Black & Decker Inc., New Britain, CT (US)

(72) Inventors: Robert J. Cirincione, II, Towson, MD (US); Earnest N. Copeland, Jr., Abingdon, MD (US); Xiating Jiang, Nanjing (CN); Donghua Wang, Suzhou (CN)

(73) Assignee: Black & Decker Inc., New Britain, CT (US)

( * ) Notice: Subject to any disclaimer, the term of this patent is extended or adjusted under 35 U.S.C. 154(b) by 11 days.

(21) Appl. No.: 15/340,228

(22) Filed: Nov. 1, 2016

(65) Prior Publication Data

US 2017/0119137 A1 May 4, 2017

Related U.S. Application Data

(60) Provisional application No. 62/249,734, filed on Nov. 2, 2015.

(51) Int. Cl.

| | |
|---|---|
| ***A45F 5/00*** | (2006.01) |
| ***B25H 3/00*** | (2006.01) |
| ***B25F 5/02*** | (2006.01) |

(52) U.S. Cl.

CPC ..... *A45F 5/00* (2013.01); *B25F 5/02* (2013.01); *B25H 3/00* (2013.01); *A45F 2005/006* (2013.01); *A45F 2200/0575* (2013.01)

(58) Field of Classification Search

CPC ..... A45F 2200/0575; A45F 2005/006; Y10S 224/904; B25H 3/00

USPC ..... 224/220, 254, 904; 182/5; 42/85; 24/3.13

See application file for complete search history.

(56) References Cited

U.S. PATENT DOCUMENTS

| | | | | |
|---|---|---|---|---|
| D139,568 | S * | 11/1944 | Hinchman | D8/356 |
| 4,558,495 | A * | 12/1985 | Olsen | B23B 45/006 24/16 PB |
| 4,678,059 | A * | 7/1987 | Bowker | A62B 1/04 182/5 |

(Continued)

FOREIGN PATENT DOCUMENTS

| | | |
|---|---|---|
| CA | 2509084 | 12/2006 |
| GB | 2500666 | 10/2013 |
| JP | 2001170878 | 6/2001 |

OTHER PUBLICATIONS

Executed EP Search report dated Jul. 18, 2017 issued in corresponding EP Application No. 16196810.2.

*Primary Examiner* — Justin Larson
(74) *Attorney, Agent, or Firm* — Amir R. Rohani

(57) ABSTRACT

A tethering attachment assembly is provided for attachment to an apparatus to facilitate connection of a lanyard to the apparatus. The tethering attachment assembly includes a pair of posts and a coil element including metallic material that substantially resiliently retains its state with application of force up to a limit, and is permanently plastically deformable upon application of force exceeding the limit. The coil element has two ends attached to the elongated posts and adapted to form a substantially U-shaped hook when the elongated posts are attached to the apparatus. A sleeve is tubularly disposed around the coil element to substantially cover the coil element.

19 Claims, 7 Drawing Sheets

(56) References Cited

U.S. PATENT DOCUMENTS 5,332,071 A * 7/1994 Duncan ..... A62B 35/04 188/371
5,816,458 A * 10/1998 Yonenoi ..... A45F 5/02 224/182
D430,005 S * 8/2000 Stearns ..... D8/380
6,095,282 A * 8/2000 Sadeck ..... A62B 1/04 182/191
D458,533 S * 6/2002 Sonju ..... A63B 29/02 D8/356
6,776,317 B1 8/2004 Parker
6,835,032 B1 12/2004 Pozgay et al.
6,868,586 B1 * 3/2005 Hall ..... A63B 21/0552 24/115 A
7,093,329 B1 * 8/2006 Chiu ..... A63B 21/0552 24/300
7,458,135 B2 * 12/2008 Mikesell ..... B25H 3/006 24/300
D618,536 S * 6/2010 Eason ..... D8/349
7,819,787 B2 * 10/2010 Kassel ..... A63B 21/00043 24/300
D675,084 S * 1/2013 Moreau ..... A45F 5/00 D8/356
D676,311 S * 2/2013 Moreau ..... D8/356
8,403,132 B2 * 3/2013 Moreau ..... A45F 5/021 206/234
D679,577 S * 4/2013 Moreau ..... D8/356
D684,845 S * 6/2013 Wood ..... A62B 35/04 D8/356
8,567,290 B2 * 10/2013 Moreau ..... B25B 7/00 248/309.1
8,646,768 B2 * 2/2014 Kish ..... A45F 5/00 224/251
D706,123 S * 6/2014 Mathews ..... D8/382
D710,186 S * 8/2014 Earley ..... D8/354
D713,240 S * 9/2014 Chance ..... D8/356
D718,117 S * 11/2014 Moreau ..... A45F 5/00 D8/356
8,919,629 B2 * 12/2014 Moreau ..... A45F 5/004 2/66
8,997,317 B2 * 4/2015 Rinklake ..... A62B 35/04 24/300
9,232,850 B2 * 1/2016 Moreau ..... A45F 5/02
9,339,100 B2 * 5/2016 Moreau ..... A45F 5/00
9,402,457 B2 * 8/2016 Moreau ..... A45F 5/00
D775,517 S * 1/2017 Votel ..... D8/382
D789,188 S * 6/2017 Votel ..... D8/382
9,791,102 B2 * 10/2017 Moreau ..... F16M 13/04
9,801,457 B2 * 10/2017 Moreau ..... A45F 5/00
9,833,893 B2 * 12/2017 Moreau ..... B25H 3/006
2003/0102342 A1 * 6/2003 Fogg ..... A45F 5/02 224/269
2004/0200436 A1 * 10/2004 Staack ..... A01K 1/04 119/792
2008/0163464 A1 * 7/2008 Baumann ..... A45F 5/02 24/3.12
2010/0147912 A1 6/2010 Salentine
2012/0168472 A1 * 7/2012 Mathews ..... A45F 3/14 224/162
2012/0247994 A1 10/2012 Moreau et al.
2012/0267403 A1 * 10/2012 Ward, Jr. ..... A45F 5/00 224/219
2013/0062498 A1 3/2013 Ito et al.
2014/0013544 A1 * 1/2014 Moreau ..... A45F 5/00 24/3.12
2015/0202470 A1 * 7/2015 He ..... A62B 1/14 182/5
2015/0289633 A1 * 10/2015 Moreau ..... A45F 5/00 29/447
2016/0199678 A1 * 7/2016 Tsai ..... C08G 18/4841 248/636
2016/0227911 A1 * 8/2016 Benzakin ..... A45F 3/14
2016/0257065 A1 * 9/2016 Moreau ..... B25H 3/00
2016/0375575 A1 * 12/2016 Moreau ..... B25H 3/00 29/401.1
2017/0119137 A1 * 5/2017 Cirincione, II ..... A45F 5/00

* cited by examiner

IMPACT-ABSORBING TETHERING ATTACHMENT

CROSS-REFERENCE TO RELATED APPLICATION

This application claims the benefit of U.S. Provisional Application No. 62/249,734 filed Nov. 2, 2015, which is incorporated herein by reference in its entirety.

FIELD OF THE DISCLOSURE

This disclosure relates to a tethering attachment. More particularly, the present invention relates to an impact-absorbing tethering attachment mechanism for use with an apparatus such as a power tool.

BACKGROUND

For power tools and hand tools used in construction at high elevation, tool operators often fasten or tether a safety lanyard or hook to the tool to protect the tool, as well as those working at lower levels, in the event the tool is dropped. Without a tether connection, the drop often damages the tool even without direct impact with the ground, as the kinetic energy of the tool is transferred to the tool housing. However, many conventional tools do not provide adequate locations to attach a lanyard, and the user is forced to hook the lanyard directly to, for example, the tool handle. Furthermore, a lanyard suitable for a small tool might not have sufficient strength to handle the weight of a heavier and bulkier tool. In the event of a fall, even without impact with the ground, the energy from the fall often damages the internal components of the tool. What is desired is to provide a connectivity mechanism on the tool itself that would encompass the energy-absorbing characteristics needed to protect the tool.

SUMMARY

According to an embodiment of the invention, a tethering attachment assembly is provided for attachment to an apparatus to facilitate connection of a lanyard to the apparatus. In an embodiment, the tethering attachment assembly includes a pair of posts and a coil element including metallic material that substantially resiliently retains its state with application of force up to a limit, and is permanently plastically deformable upon application of force exceeding the limit, the coil element having two ends attached to the elongated posts and adapted to form a substantially U-shaped hook when the elongated posts are attached to the apparatus. In an embodiment, a sleeve is tubularly disposed around the coil element to substantially cover the coil element.

In an embodiment, the tethering attachment assembly further includes a pair of rivets that pivotably attach the ends of the coil element to the posts. In an embodiment, the coil element includes extended portions engaging the rivets.

In an embodiment, the tethering attachment assembly further includes a secondary sleeve disposed at ends of the sleeve. In an embodiment, the secondary sleeve is disposed around attachment points of the coil elements to the posts.

In an embodiment, the sleeve includes a webbing of material.

In an embodiment, the sleeve is configured to tear when the coil element is deformed to expose the coil element.

According to an embodiment of the invention, an apparatus is provided including a housing and a tethering attachment assembly attached to the housing and adapted to facilitate connection of a lanyard to the apparatus. In an embodiment, the tethering attachment assembly includes a pair of posts attached to the housing, and a coil element including metallic material that substantially resiliently retains its state with application of force up to a limit, and is permanently plastically deformable upon application of force exceeding the limit. In an embodiment, the coil element includes two ends attached to the posts and adapted to form a substantially U-shaped hook when the posts are attached to the apparatus. In an embodiment, a sleeve is tubularly disposed around the coil element to substantially cover the coil element.

In an embodiment, the tethering attachment assembly further includes a pair of rivets that pivotably attach the ends of the coil element to the posts. In an embodiment, the coil element includes extended portions engaging the rivets.

In an embodiment, the tethering attachment assembly further includes a secondary sleeve disposed at ends of the sleeve. In an embodiment, the secondary sleeve is disposed around attachment points of the coil elements to the posts.

In an embodiment, the sleeve comprises a webbing. In an embodiment, the sleeve is configured to tear when the coil element is deformed to expose the coil element.

In an embodiment, the apparatus comprises a power tool having a motor disposed within the housing. In an embodiment, the apparatus comprises a hand tool.

In an embodiment, the housing defines a pair of elongated slots for receiving the posts therein. In an embodiment, the posts of the tethering attachment assembly are removeably received within the elongated slots of the housing. In an embodiment, the housing includes side through-holes or receptacles arranged to received pins or fasteners for securing the elongated posts of the tethering attachment assembly within the elongated slots of the housing.

BRIEF DESCRIPTION OF THE DRAWINGS

In the accompanying drawings which form part of the specification.

Corresponding reference numerals indicate corresponding parts throughout the several figures of the drawings.

DESCRIPTION

Figure 1:
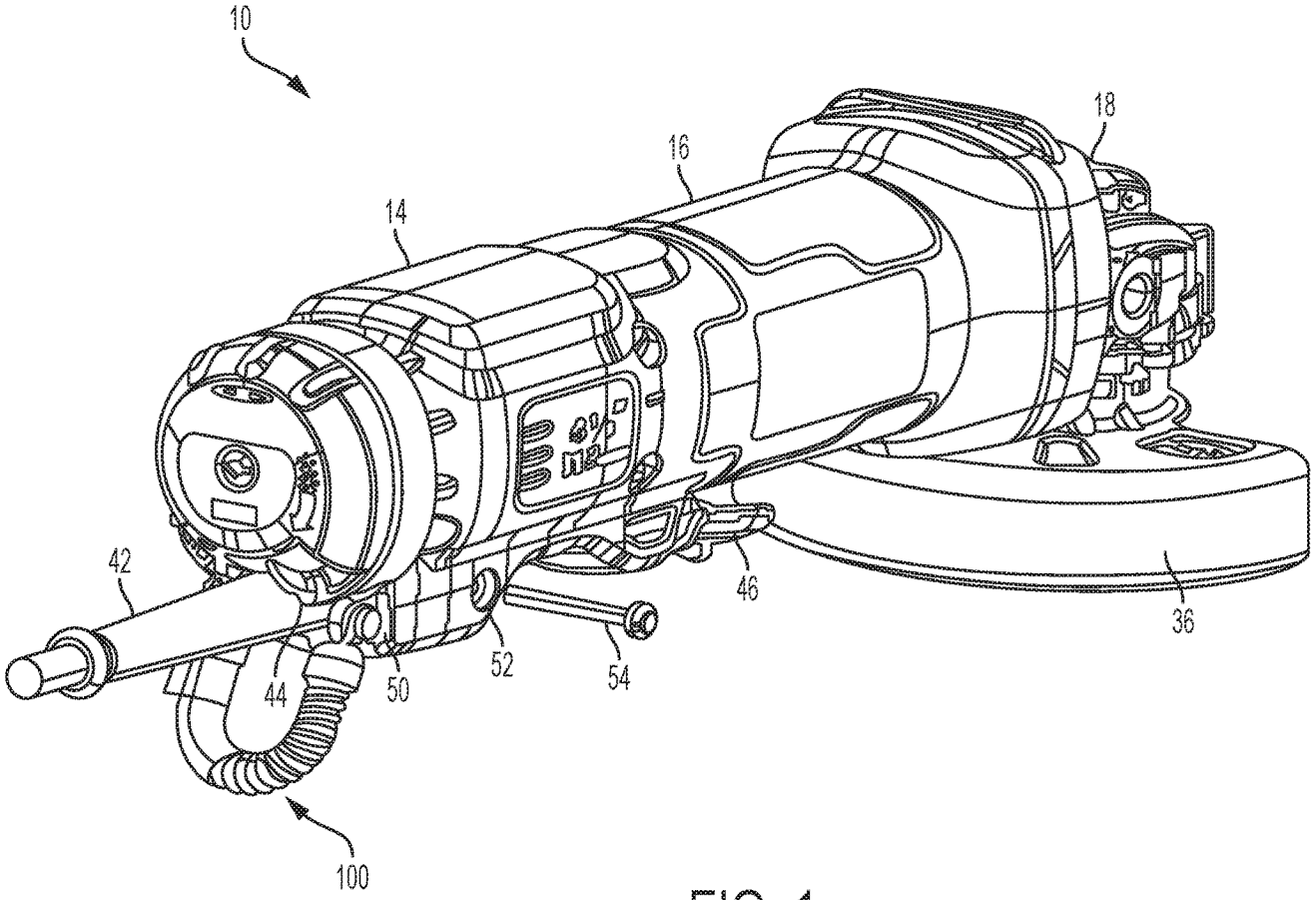
FIG. 1 depicts a rear perspective view of a power tool, in accordance with an embodiment.
Figure 2:
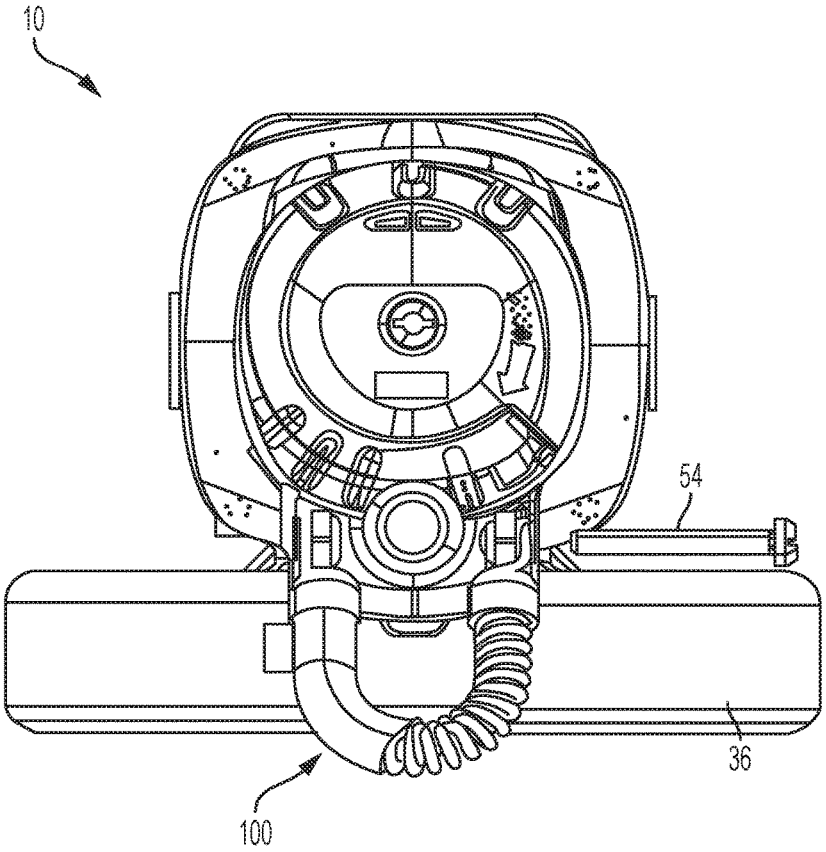
FIG. 2 depicts a rear axial view of the power tool, according to an embodiment.

With reference to FIGS. 1 and 2, an embodiment of a power tool, in this case an angle grinder 10, is depicted with a tethering attachment assembly 100. While an angle grinder 10 is depicted herein by way of example, it will be readily appreciated that the described tethering attachment assembly 100 may be utilized with any power tool, including but not limited to, sanders, saws, impact drivers, hammers, etc. Additionally, the tethering attachment assembly 100 may be employed for any other apparatus, including but not limited to, hand tools, outdoor products, power generators, etc. that may be used at higher ground.

According to an embodiment, the angle grinder 10 includes a housing having a handle portion 14, a field case 16, and a gear case 18. In an embodiment, the handle portion 14 is fixedly attached to a first end of the field case 16, and the gear case 18 is fixedly attached to a second end of the field case 16. In an embodiment, the field case 16 supports a motor (not shown) having a motor spindle that extends into the gear case 18 for driving gearset supported therein. In an embodiment, a wheel spindle (not shown) extends from gear case and is driven by the motor spindle through the gearset. In an embodiment, the axis of rotation of motor spindle is generally perpendicular to the axis of rotation of the wheel spindle. In an embodiment, a grinder wheel (not shown) is selectively attachable to the wheel spindle and is rotatably driven thereby. In an embodiment, the grinder wheel is guarded by a wheel guard 36.

In an embodiment, power tool 10 is a corded tool, where the handle portion 14 includes an opening 44 at its distal end opposite the connection end to the field case 16, through which a power cord 45 is received. Alternatively, power tool 10 may be cordless having a battery receptacle for receiving one or more battery packs.

In an embodiment, the motor is in electrical communication with a switch (not shown). The switch is in turn in contact with a power source via power cord 42. In an embodiment, a trigger 46 is in mechanical communication with the switch for selectively supplying power from the power source to the motor. Mechanical actuation of the trigger 46 may result in actuation of the switch, which activates the motor.

In an embodiment, tethering attachment assembly 100 is removeably attached to a lower rear end 48 of the handle portion 14 below the opening 44 and the power cord 42. In an embodiment, the end 28 of the handle portion 14 is provided with a pair of elongated slots 50 around the opening 44 for receiving a pair of elongated posts 102 of the tethering attachment assembly 100, as discussed below. In an embodiment, a pair of side through-holes or receptacles 52 are provided intersecting the elongated slots 50. A pair of pins or fasteners 54 are received through the through-holes or receptacles 52 to securely hold the posts 102 of tethering attachment assembly 100 within the elongated slots 50.

In an embodiment, the tethering attachment assembly 100 provides an attachment point for the user to attach a lanyard in order to protect the tool in the event of a fall. The advantages of this tethering attachment assembly 100 are discussed in detail below.

Figure 3:
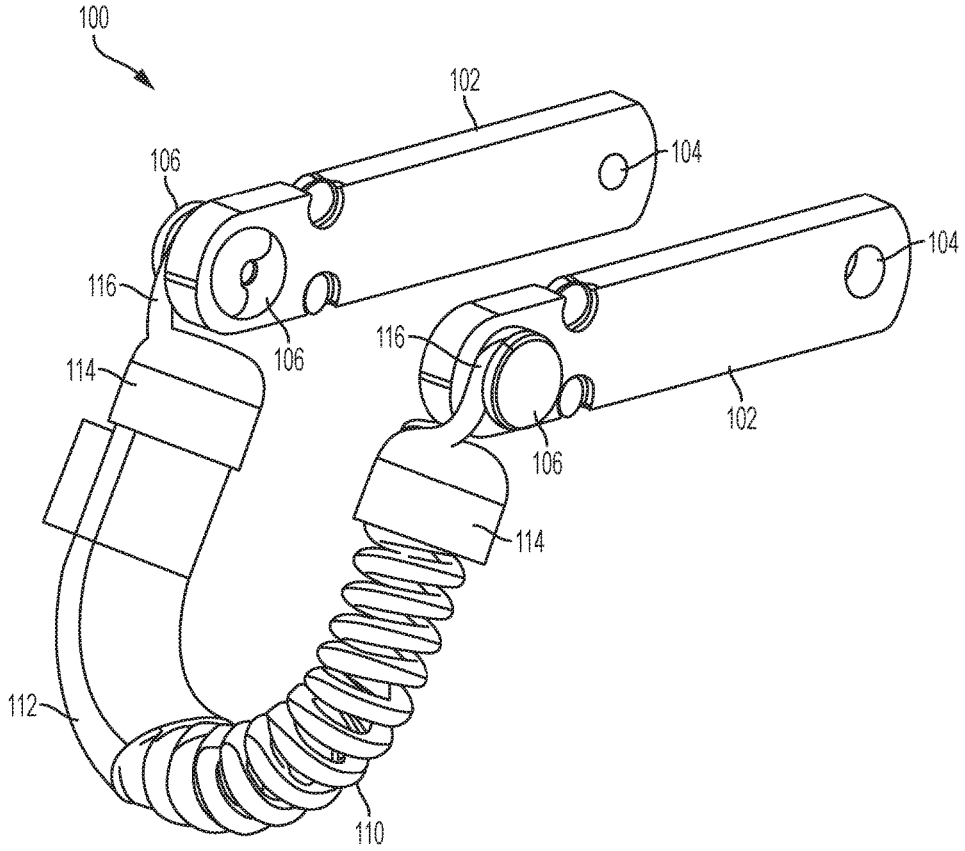
FIG. 3 depicts a perspective view of a tethering attachment assembly, according to an embodiment.

FIG. 3 depicts a perspective view of the tethering attachment assembly, according to an embodiment. In an embodiment, the tethering attachment assembly 100 integrally includes a coil element 110. In an embodiment, coil element 110 is made of elastic metal as a compression spring treated to be deformable upon application of heavy force exceeding a limit. Specifically, the coil element 110 is designed and manufactured in a way that it resiliently yields and deforms against application of significant kinetic energy resulting from a fall or drop at high height.

In an embodiment, a sleeve 112 made of a webbing of material, e.g., nylon, ballistic nylon, synthetic fiber, polypropylene, or cotton, or of plastic material. In an embodiment, sleeve 112 substantially covers the coil element 110. In FIG. 3, the sleeve 112 is partially depicted to expose part of the coil element 110, though it must be understood that the sleeve 112 substantially covers the entire length of the coil element 110. In an embodiment, the sleeve 112 is tubularly disposed around the coil element 110 and fastened to the ends of the coil element 110 to restrain the coil from being stretched under normal use operation. However, in the event of a fall at height, the sleeve 112 tears away under heavy stress, allowing the coil element 110 to deform and be exposed to the user.

In an embodiment, ends of the coil element 110 include extended portions 116 attached to posts 102 via rivets 106. In an embodiment, a secondary sleeve 114, such as a heat-shrink tubing, is disposed at the ends of the sleeve 112 and/or the extended portions 116.

In an embodiment, for attachment of the tethering attachment assembly 100 to the power tool 10, the two posts 102 are brought close together and inserted into elongated slots 50 of the power tool 10. To do this, the coil element 110 is bent to form a substantially U-shaped hook.

In an embodiment, a lanyard may be attached to the tethering attachment assembly 100 (e.g., directly or via a carabiner) when the power tool 10 is in use at higher grounds. As understood in the industry, and for the purposes of this disclosure, a lanyard may refer to any cable, strap, rope or cord, typically with "ready to use" terminations such as hooks or carabiners, intended for securing objects for "at height" use.

In the event the power tool 10 is dropped, the coil element 110 significantly absorbs the energy of the fall, which can be significant depending on the mass of tool and distance dropped. In most instances, i.e., where the length of the lanyard is relatively small and the power tool 10 is not too heavy, the coil element 110 likely absorbs the kinetic energy of the fall without damage or deformity to the tethering attachment assembly 100 or the power tool 10. However, where the distance of the drop is too long and/or the tool 10 is too heavy, the likelihood of the drop damaging the power tool internal components is high. In this case, while the coil element 110 absorbs some of the kinetic energy of the fall, it will deform and rip the sleeve 112 if the kinetic energy of the fall exceeds a predetermined limit. This notified the user that the power tool 10 has been dropped and likely damaged.

Figure 5:
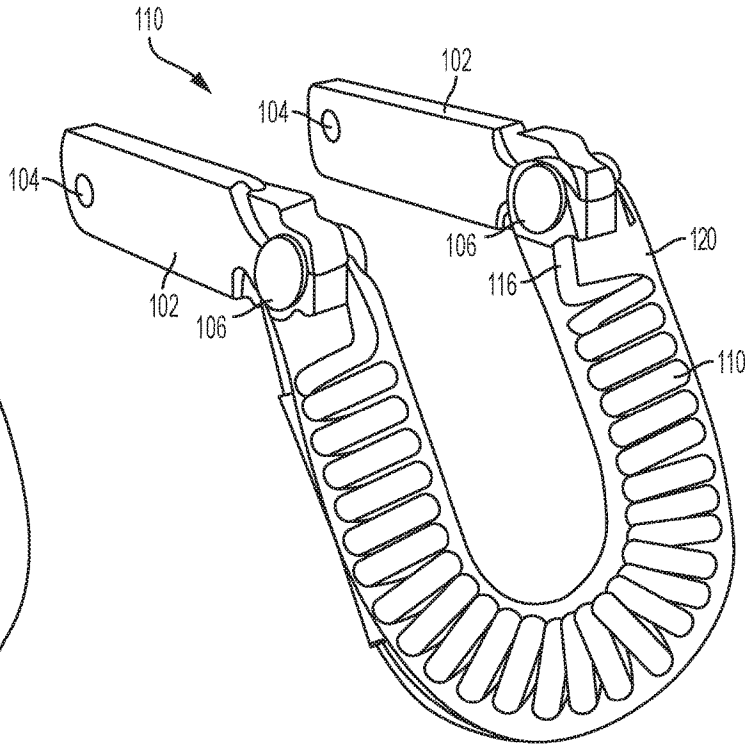
FIGS. 4 and 5 depict two perspective views of an alternative tethering attachment assembly, the latter showing a sleeve transparently, according to an embodiment.
Figure 4:
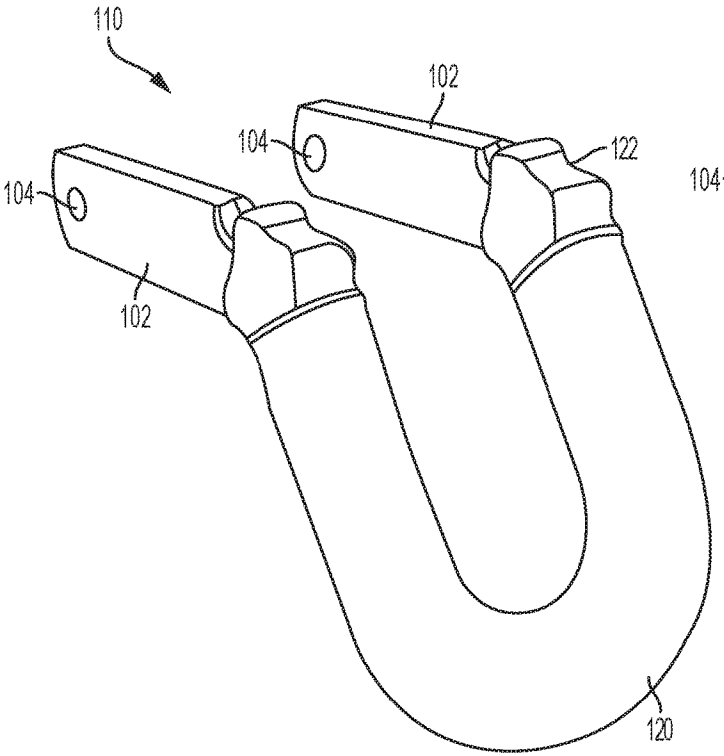

FIGS. 4 and 5 depict two perspective views of an alternative tethering attachment assembly, the latter showing a plastic cover transparently, according to an embodiment. In this embodiment, the sleeve 120 covers not only the coil element 110, but also the extended portions 116. In addition, the secondary sleeve 122, which in an embodiment is made of heat-shrink tubing, covers the attachment points of the extended portions 116 to the posts 102, including rivets 106.

Figure 6:
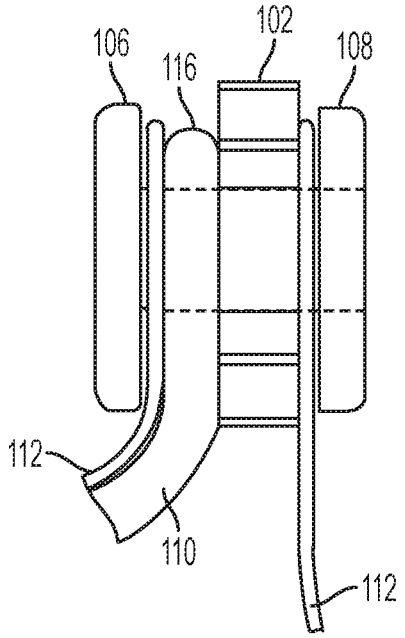
FIG. 6 depicts a side video of the riveting connection for the tethering attachment assembly, according to an embodiment.
Figure 7:
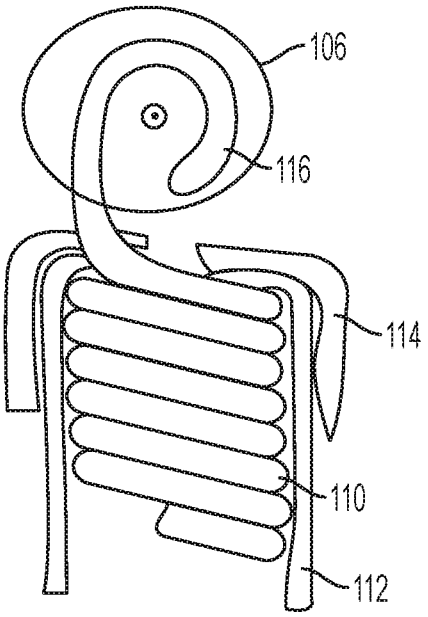
FIG. 7 depicts a cross-sectional view of the riveting connection for the tethering attachment assembly, according to an embodiment.

FIG. 6 depicts a side view of the riveting connection between the extended portion 116 of the coil element 110 and the post 102, according to an embodiment. FIG. 7 depicts a cross sectional view of the same riveting connection, according to an embodiment. In an embodiment, the extended portion 116 wraps around the axis of the rivet 106 adjacent the post 102, and the end 108 of the rivet 106 axially secures the extended portion 116 to the post 102. The rivet 106 provides some rotational flexibility for the tethering attachment assembly 100.

Figure 8:
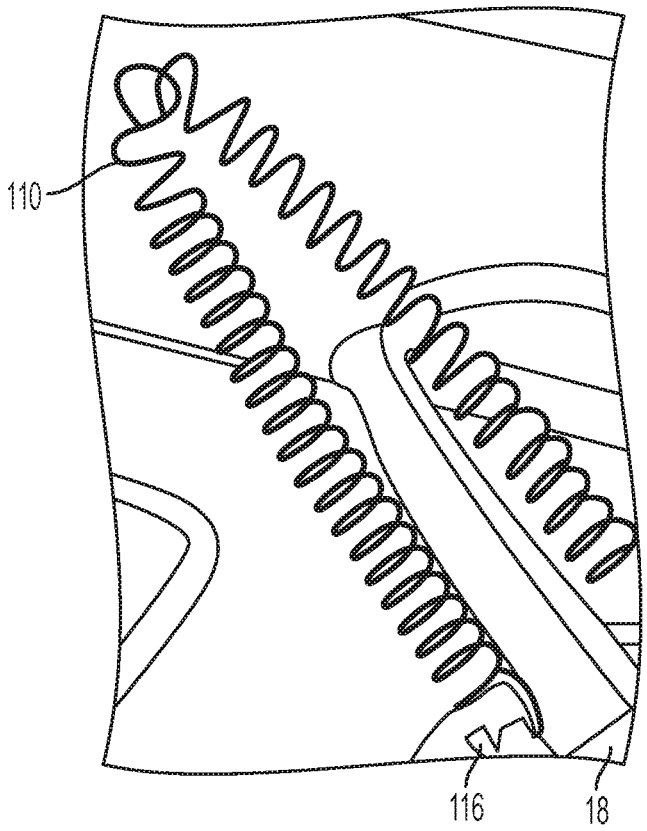
FIG. 8 depicts a perspective view of a tethering attachment assembly deformed after a power tool drop, according to an embodiment.

FIG. 8 depicts a perspective view of a tethering attachment assembly deformed after a power tool drop, according to an embodiment. As shown herein, after application of kinetic force exceeding a threshold amount to the coil element 110, the coil element 110 does not return to its original state and is permanently deformed.

In an embodiment, the size and length of the rivets 106 and posts 102 may be adjusted based on the weight of the tool 10 and the positioning of the tethering attachment assembly 100. Furthermore, the size, thickness, and material used for the coil element 110 and the cover 112 can be adjusted depending on the weight of the tool 10. For example, if the tool mass increased a larger diameter spring wire, spring diameter, and number of turns can be adjusted to change the spring rate and ultimately the energy absorbing characteristics of spring. The cover 112 material can be similarly selected to depending on the tool weight and approved height.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. A tethering attachment assembly adapted for attachment to an apparatus to facilitate connection of a lanyard to the apparatus, the tethering attachment assembly comprising:

a pair of posts;

a coil element comprising metallic material that is elastically resilient with application of force up to a limit, and is permanently plastically deformable upon application of force exceeding the limit, the coil element having two ends attached to the posts and including a U-shaped portion when the posts are attached to the apparatus; and a sleeve tubularly disposed around and covering the U-shaped portion of the coil element.

2. The tethering attachment assembly of claim 1, further comprising a pair of rivets that pivotably attach the ends of the coil element to the posts.

3. The tethering attachment assembly of claim 2, wherein the coil element comprises extended portions engaging the rivets.

4. The tethering attachment assembly of claim 1, further comprising a secondary sleeve disposed at ends of the sleeve.

5. The tethering attachment assembly of claim 4, wherein the secondary sleeve is disposed around attachment points of the coil elements to the posts.

6. The tethering attachment assembly of claim 1, wherein the sleeve comprises a webbing of material.

7. The tethering attachment assembly of claim 1, wherein the sleeve is configured to tear when the coil element is deformed to expose the coil element.

8. An apparatus comprising:

a housing; and a tethering attachment assembly attached to the housing and adapted to facilitate connection of a lanyard to the apparatus, the tethering attachment assembly comprising:

a pair of posts attached to the housing;

a coil element comprising metallic material that is elastically resilient with application of force up to a limit, and is permanently plastically deformable upon application of force exceeding the limit, the coil element having two ends attached to the posts and including a U-shaped portion when the posts are attached to the apparatus; and a sleeve tubularly disposed around and covering the U-shaped portion of the coil element.

9. The apparatus of claim 8, wherein the tethering attachment assembly further comprising a pair of rivets that pivotably attach the ends of the coil element to the posts.

10. The apparatus of claim 9, wherein the coil element comprises extended portions engaging the rivets.

11. The apparatus of claim 8, wherein the tethering attachment assembly further comprises a secondary sleeve disposed at ends of the sleeve.

12. The apparatus of claim 11, wherein the secondary sleeve is disposed around attachment points of the coil elements to the posts.

13. The apparatus of claim 8, wherein the sleeve comprises a webbing.

14. The apparatus of claim 8, wherein the sleeve is configured to tear when the coil element is deformed to expose the coil element.

15. The apparatus of claim 8, wherein the apparatus comprises a power tool having a motor disposed within the housing.

16. The apparatus of claim 8, wherein the apparatus comprises a hand tool.

17. The apparatus of claim 8, wherein the housing defines a pair of elongated slots for receiving the posts therein.

18. The apparatus of claim 17, wherein the posts of the tethering attachment assembly are removeably received within the elongated slots of the housing.

19. The apparatus of claim 18, wherein the housing includes side through-holes or receptacles arranged to received pins or fasteners for securing the posts of the tethering attachment assembly within the elongated slots of the housing.

* * * * *